United States Patent [19]

Warner, Sr.

[11] 4,150,517

[45] Apr. 24, 1979

[54] REPLACEABLE CORNER MOLDING

[76] Inventor: Robert L. Warner, Sr., 6395 Lake "O" Springs Ave. NW., Canton, Ohio 44718

[21] Appl. No.: 864,543

[22] Filed: Dec. 27, 1977

[51] Int. Cl.[2] ..... E04D 1/36; E04C 1/39

[52] U.S. Cl. ..... 52/288; 52/718

[58] Field of Search ..... 52/288, 287, 278, 717, 52/718

[56] References Cited

U.S. PATENT DOCUMENTS

| | | | |
|---|---|---|---|
| 2,328,651 | 9/1943 | Kern | 52/288 |
| 3,201,909 | 8/1965 | Grün | 52/287 |
| 3,302,350 | 2/1967 | Brown et al. | 52/288 X |
| 3,422,584 | 1/1969 | Howard | 52/288 X |
| 3,473,278 | 10/1969 | Gossen | 52/287 |
| 3,481,092 | 12/1969 | Constantino | 52/288 |
| 3,667,177 | 6/1972 | Biela | 52/287 |
| 3,707,061 | 12/1972 | Collette | 52/288 |

FOREIGN PATENT DOCUMENTS

| | | | |
|---|---|---|---|
| 1170494 | 9/1958 | France | 52/288 |
| 1020164 | 2/1966 | United Kingdom | 52/288 |
| 1328807 | 9/1973 | United Kingdom | 52/287 |

*Primary Examiner*—Alfred C. Perham
*Attorney, Agent, or Firm*—Daniel Jay Tick

[57] ABSTRACT

A replaceable corner molding for a corner formed by two walls each having a planar surface meeting the other perpendicularly, has a base member consisting of an elongated strip affixed to the meeting walls. The base member is of L-shaped cross-section and has a projecting strip extending from the inside surfaces of its legs at their area of intersection and equiangularly spaced from the inner surface. A head strip of circular cross-section is provided at the free end of the projecting strip farthest from the base member. A molding member consists of an elongated strip of L-shaped cross-section having a slot of circular cross-section extending along its length at the area of intersection of its legs, equiangularly spaced from the outer surfaces of the legs for accommodating the head strip of the projecting strip of the base member. The slot has a narrow neck part for releasably securing the head strip in the slot.

1 Claim, 3 Drawing Figures

REPLACEABLE CORNER MOLDING

BACKGROUND OF THE INVENTION

The present invention relates to a replaceable corner molding. More particularly, the invention relates to a replaceable corner molding for a corner formed by two walls each having a substantially planar surface meeting the other substantially perpendicularly.

Moldings are disclosed in the following United States patents. U.S. Pat. No. 2,328,651, issued Sept. 7, 1943 to Kern, U.S. Pat. No. 3,201,909, issued Aug. 24, 1965 to Grun, U.S. Pat. No. 3,302,350, issued Feb. 7, 1967 to Brown et al., U.S. Pat. No. 3,422,584, issued Jan. 21, 1969 to Howard, U.S. Pat. No. 3,481,092, issued Dec. 2, 1969 to Constantino and U.S. Pat. No. 3,667,177, issued June 6, 1972 to Biela.

Objects of the invention are to provide a replaceable corner molding of simple structure, which is inexpensive in manufacture, installed with facility and convenience in new and existing structures, and functions efficiently, effectively and reliably as a removeable molding which may be replaced as desired.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 2:
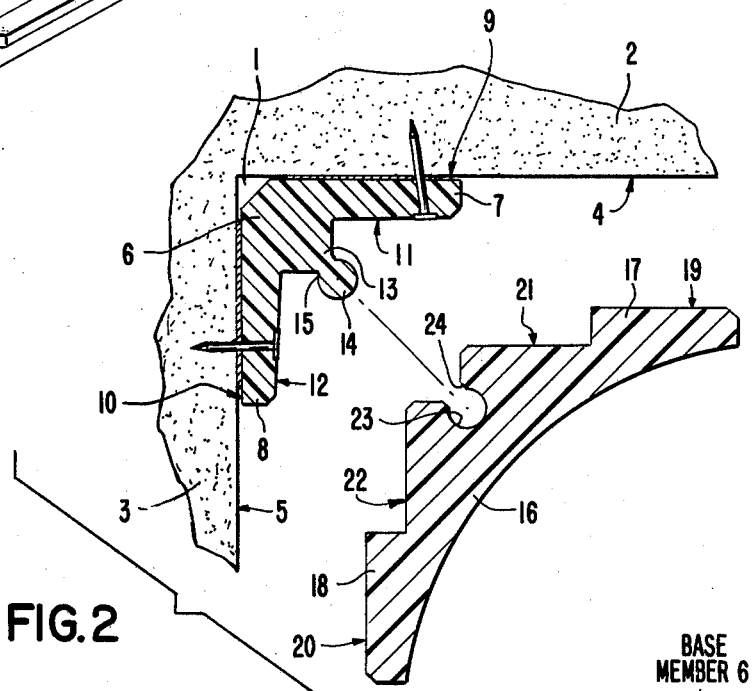
FIG. 2 is a cross-sectional view, on an enlarged scale, of an embodiment of FIG. 1.

The replaceable corner molding of the invention is for a corner 1 formed by two walls 2 and 3 having substantially planar surfaces 4 and 5, respectively, as shown in FIG. 2. The planar surface of each of the walls 2 and 3 meets the other substantially perpendicularly, as shown in FIG. 2.

Figure 1:
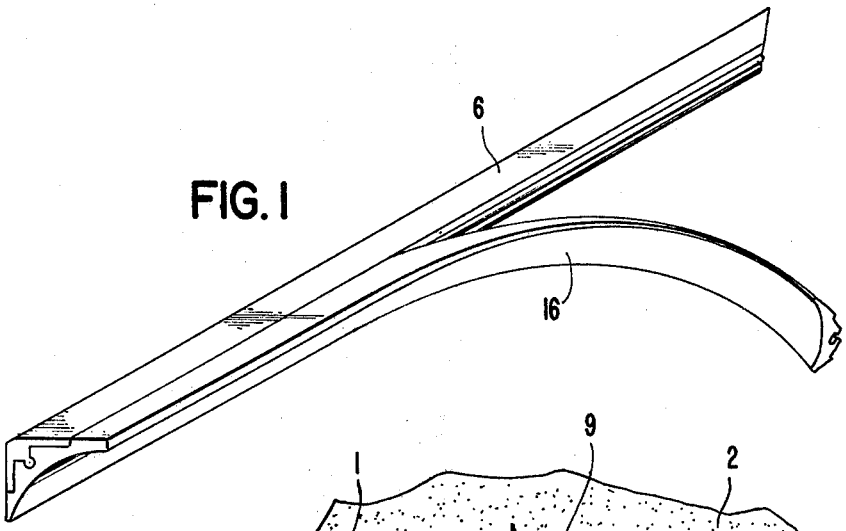
FIG. 1 is a perspective view of an embodiment of the replaceable corner molding of the invention in the process of being affixed to, or removed from, a wall.

The corner molding of the invention comprises a base member 6 consisting of an elongated strip of any suitable material such as, for example, plastic, affixed to the meeting walls 2 and 3. The base member 6 has a substantially L-shaped cross-section, as shown in FIGS. 1 and 2, having a pair of legs 7 and 8 meeting each other at substantially right angles, as shown in FIG. 2. The legs 7 and 8 have outer surfaces 9 and 10, respectively, abutting the planar surfaces 4 and 5 of the walls 2 and 3, respectively, and inner surfaces 11 and 12, respectively, meeting each other at the inside of the base member 6.

The base member 6 has a projecting strip 13 extending from the inner surfaces 11 and 12 of the legs 7 and 8 thereof, respectively, at their area of intersection and equiangularly spaced from said inner surfaces, as shown in FIG. 2. A head strip 14 (FIG. 2) of substantially circular cross-section is provided at the free end 15 of the projecting strip 13 farthest from the base member 6.

A molding member 16 (FIGS. 1 and 2) consists of an elongated strip of substantially L-shaped cross-section having a pair of legs 17 and 18 meeting each other at substantially right angles, as shown in FIG. 2. The legs 17 and 18 have outer surfaces 19 and 20, respectively, as shown in FIG. 2, abutting the planar surfaces 4 and 5 of the corresponding walls 2 and 3, respectively. Indentations 21 and 22 are formed in the outer surfaces 19 and 20 of the legs 17 and 18, respectively, as shown in FIG. 2, for accommodating the inner surfaces 11 and 12 of the legs 7 and 8, respectively, of the base member 6, in the manner shown in FIG. 1.

The molding member 16 has a slot 23 of substantially circular cross-section extending along its length at the area of intersection of the legs 17 and 18 thereof and equiangularly spaced from the outer surfaces 19 and 20 of said legs, as shown in FIG. 2. The slot 23 of the molding member 16 accommodates the head strip 14 of the projecting strip 13 of the base member 6, as shown in FIG. 1. The slot 23 has a narrow neck part 24 (FIG. 2) whereby the head strip 14 of the projecting strip 13 of the base member 6 is releasably secured in said slot. Thus, the molding member 16 is installed by pressing it onto the base member 6 in a manner whereby the head strip 14 of said base member is accommodated and secured in the slot 16 of said molding member.

Figure 3:
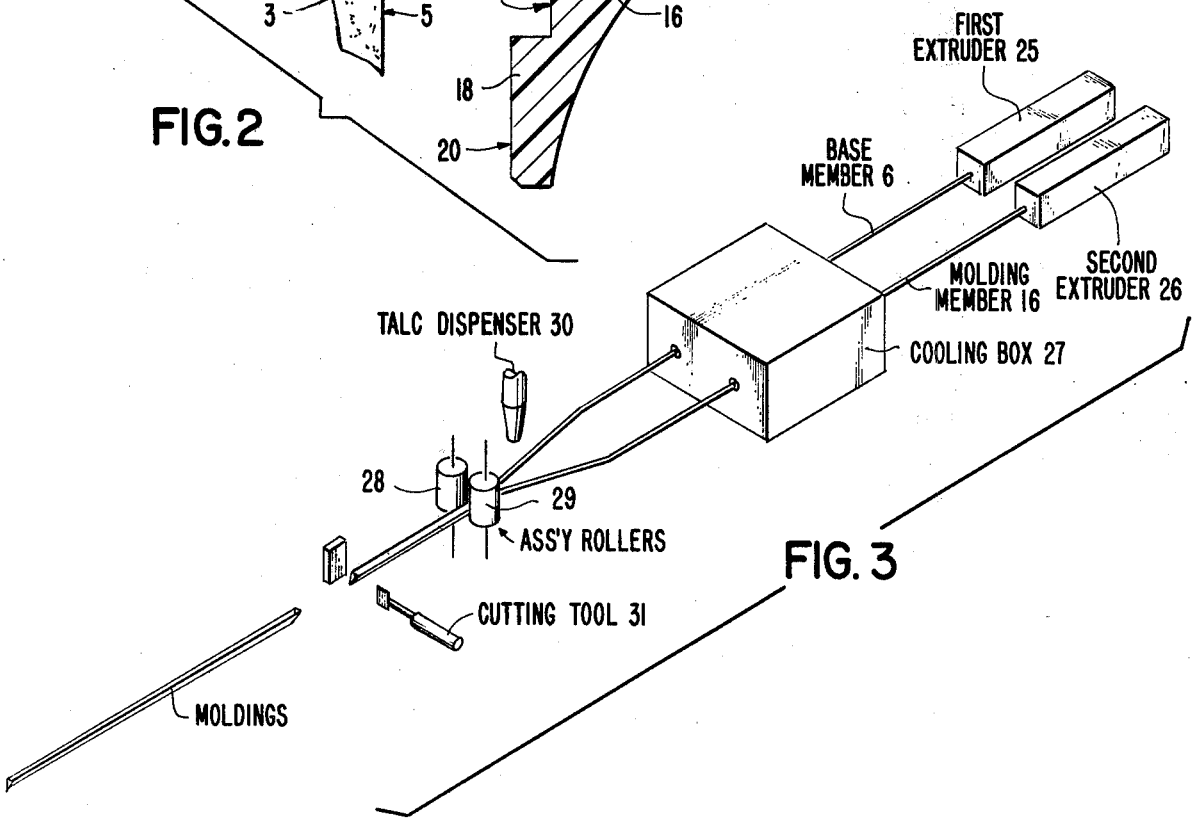
FIG. 3 is a block diagram illustrating a method of manufacture of the replaceable corner molding of the invention.

FIG. 3 illustrates a method of manufacture of the replaceable corner molding of the invention. In the method of manufacture illustrated in FIG. 3, a first extruder 25 extrudes plastic in the shape of the base member 6 and a second extruder 26 extrudes plastic in the shape of the molding member 16.

The base member 6 and the molding member 16 are independently and separately cooled in a cooling box 27 and are thence pressed together by a pair of assembly rollers 28 and 29, after being sprinkled with talc via a talc dispenser 30.

Desired lengths of the molding are cut off by a cutting tool 31. The end result of the method of manufacture is a plurality of fully assembled moldings precut to desired lengths of 8, 10 and 12 feet, or the like.

While the invention has been described by means of a specific example and in a specific embodiment, I do not wish to be limited thereto, for obvious modifications will occur to those skilled in the art without departing from the spirit and scope of the invention.

I claim:

1. A replaceable corner molding for a corner formed by two walls each having a substantially planar surface meeting the other substantially perpendicularly, said molding comprising a base member consisting of an elongated strip affixed to the meeting walls, said base member having a substantially L-shaped cross-section having a pair of legs meeting each other at substantially right angles, each of the legs having an outer surface abutting a corresponding one of the walls and an inner surface meeting the other at the inside of said base member, said base member having a projecting strip extending from the inner surfaces of the legs thereof at their area of intersection and equiangularly spaced from said inner surfaces and a head strip of substantially circular cross-section at the free end of the projecting strip farthest from the base member; and a molding member consisting of an elongated strip of substantially L-shaped cross-section having a pair of legs meeting each other at substantially right angles, each of the legs having an outer surface partially abutting a corresponding one of the walls with indentations therein for accommodating the inner surfaces of the legs of the base member, said molding member having a slot of substantially circular cross-section extending along its length at the area of intersection of the legs thereof, equiangularly spaced from the outer surfaces of the legs of said molding member for accommodating the head strip of the projecting strip of said base member, said slot having a narrow neck part whereby the head strip of said projecting strip is releasably secured in said slot.

* * * * *